United States Patent [19]

Hasler et al.

[11] Patent Number: 4,645,510

[45] Date of Patent: Feb. 24, 1987

[54] EXHAUST DYEING OF CELLULOSIC SUBSTRATES WITH REACTIVE DYES CONTROLLED SIMULTANEOUS ADDITION OF SALT AND ALKALI

[75] Inventors: Rolf Hasler, Bottmingen, Switzerland; Francis Palacin, Riedisheim, France

[73] Assignee: Sandoz Ltd., Basel, Switzerland

[21] Appl. No.: 738,074

[22] Filed: May 24, 1985

[30] Foreign Application Priority Data

Jun. 1, 1984 [DE] Fed. Rep. of Germany ..... 3420383

[51] Int. Cl.[4] ..... D06B 23/28; D06P 3/60

[52] U.S. Cl. ..... 8/400; 8/534; 8/539; 8/654; 8/676; 8/680; 8/917; 8/918; 8/922; 8/924; 8/927

[58] Field of Search ..... 8/549, 400, 534, 539, 8/654, 676, 924, 927, 917, 918, 680

[56] References Cited

U.S. PATENT DOCUMENTS 4,089,644 5/1978 Carbonell et al. ..... 8/400

4,372,744 2/1983 Hildebrand et al. ..... 8/400

FOREIGN PATENT DOCUMENTS 1458632 12/1976 United Kingdom .

OTHER PUBLICATIONS

Trotman, E. R., Dyeing and Chemical Technology of Textile Fibers, 1970 pp. 526–529, Griffin, London, England.

*Primary Examiner*—Paul Lieberman
*Assistant Examiner*—Brooks Alan Truskett
*Attorney, Agent, or Firm*—Gerald D. Sharkin; Richard E. Vila; Thomas C. Doyle

[57] ABSTRACT

The invention provides a process for the exhaust dyeing with a reactive dyestuff of a textile material comprising cellulosic fibres, which process comprises the step of adding to the dyebath containing the reactive dyestuff, simultaneously the salt and the alkali in specified quantities metered per unit time so as to give a substantially linear exhaustion of the dyebath.

39 Claims, No Drawings

EXHAUST DYEING OF CELLULOSIC SUBSTRATES WITH REACTIVE DYES CONTROLLED SIMULTANEOUS ADDITION OF SALT AND ALKALI

The invention relates to a process for the exhaust dyeing with reactive dyestuffs of a textile fibre material containing cellulosic fibres.

Exhaust dyeing of cellulosic material with reactive dyestuffs is usually carried out in the presence of an alkaline reagent and a significant amount of a salt, generally sodium sulphate or chloride. The presence of the salt is needed to promote adsorption of the dyestuff on the cellulosic fibre, whereas the alkali is necessary for the fixation of the reactive dyestuff on the fibre. It is generally acknowledged that the addition of the salt and the alkali to the dyebath is a critical factor in the production of level and reproducible dyeings. In the previously known dyeing processes, the salt is added at the beginning of the process, before the dyebath temperature is raised to the dyeing temperature. It is believed that the total amount of salt has to be present in the dyebath to obtain a good exhaustion of the dyebath before the fixation step is effected; thus, in the presence of the alkali, the dyestuff adsorbed on the fibres will react with the fibres and be significantly less hydrolysed. Fixation is effected by adding the alkali either before the dye bath temperature is raised or after the dyeing temperature has been reached. Such a dyeing process in which the dyestuff, the salt and the alkali are introduced in one step in the dyebath at room temperature is known as the "All-in" dyeing process. However, these known dyeing processes still do not give satisfactory dyeing results with respect to levelness and reproducibility combined with rationalisation of the dyeing procedure.

It has now been found that good dyeing results are obtained with reactive dyestuffs on a cellulosic fibre material when the salt is added to the dyebath simultaneously with the alkali in specified quantities per unit time.

Accordingly, the present invention provides a process for the exhaust dyeing with a reactive dyestuff of a textile material comprising cellulosic fibres, which process comprises the step of adding to the dyebath containing the reactive dyestuff, simultaneously the salt and the alkali in specified quantities metered per unit time so as to give a substantially linear exhaustion of the dyebath.

According to the invention, the salt and the alkali are added to the dyebath in small discrete quantities per unit time. These repeatedly added quantities may be equal when the addition rate is linear or may vary according to a positive or negative exponential, logarithmic or power function. Preferably the simultaneous addition is regulated according to a linear function, i.e. the quantities added per unit time remain constant throughout.

According to the invention, the simultaneous addition of the salt and the alkali is regulated so as to give substantially linear exhaustion of the dyebath, i.e. a constant percentage of the reactive dyestuff initially present is adsorbed by the substrate per unit time.

The unit time may be any constant time interval, for example expressed in seconds or minutes, or a time interval based upon the mechanical characteristics of the dyeing machine, particularly expressed in "cycles" of the dyeing machine. By cycle of the dyeing machine is meant a time interval which is based upon the movement of the dyebath and/or the movement of the substrate; this time interval may vary for each dyeing equipment used. It is defined by the number of contacts bath/substrate during the dyeing process (see for example "Chemiefaser/Textilindustrie" 26, 78, 1976, page 901 or "Melliand Textilberichte" 54, 1976, Pages 68–77). When the unit time is expressed in cycle, the corresponding time interval may be variable as the working rate of the dyeing machine may be disturbed; however, the addition rate remains regulated per cycle.

Preferably, the unit time is expressed in cycle.

In a preferred exhaust dyeing process according to the invention, the salt and the alkali are simultaneously metered at such a rate per unit time or cycle following one of the above-mentioned continuous mathematical functions, that the dyestuff is adsorbed by the substrate (or the dyebath is exhausted) at a linear rate of 0.2% to 6%, preferably 0.5% to 2%, particularly 0.5% to 1.5% based on the total dyestuff concentration used for the dyeing, per unit time.

To determine the addition function, a series of exhaust dyeing test runs are effected employing the dyestuff at the desired concentration, the salt and the alkali, the dyeing equipment and the cellulosic substrate intended to be employed in the production process. The optimal amounts of salt and alkali for a specific reactive dyestuff used at a specific concentration are either known, e.g. indicated by the dyestuff manufacturer, or can be determined according to known methods. Once the dyeing conditions, especially the temperature and the dyeing time, have been fixed, the dyestuff being introduced in the dyebath, the salt and the alkali are added simultaneously in divided quantities at a linear rate and the corresponding isothermal dyebath exhaustion is measured. It is represented on a graph (x, y-axis) as a function of time or the number of cycles (x-axis). The linear addition of the salt and the alkaline reacting agent is also plotted on the same graph as a function of time or the number of cycles of the dyebath and/or substrate, the quantities of salt and alkali added being expressed as a percentage of the total amount of salt and the total amount of the alkali required for the dyeing (y-axis).

The optimum linear dyebath exhaustion/time unit which lies within the above indicated ranges and the corresponding addition rate of the salt and the alkali have to be determined in order to obtain good levelness results. This addition rate may be calculated from the isothermal exhaustion curve and its reflection symmetry about a straight line, e.g. as disclosed in U.S. Ser. No. 656,615 (filed on Oct. 1, 1984), or from the first and second derivation of the isothermal exhaustion curve using existing computer programs, e.g. as disclosed by J. Carbonell et al in Melliand Textilberichte 54, 1973, 68–70.

In a preferred embodiment the isothermal exhaustion curve obtained under the temperature, time and addition conditions as set can be approximated to a straight line expressed as $y=ax$ in which $y=\%$ of dyebath exhaustion, $x=$unit time and $a=$slope$=$linear dyebath exhaustion rate. In this case, the addition rate of salt and alkali is that previously used for determining the isothermal exhaustion curve.

When the simultaneous addition rate of the salt and the alkali reacting agent vary in accordance with a non-linear function, this function can be determined on a data processing unit such as a desktop computer.

Having determined the addition rate of salt and alkali giving a linear dyebath exhaustion, the process is rerun metering simultaneously the salt and the alkali accordingly and the levelness of the resulting dyeing is scrutinized. If necessary, this procedure may be repeated varying the simultaneous addition rate of salt and alkali so as to obtain a linear dyebath exhaustion rate closer to the most preferred values as indicated above. The mathematical function corresponding to the final form of the addition curve or straight line may then be employed in the program of a computer controlled production process.

When a mixture of dyestuffs is used, the test runs which are effected for determining the addition rate corresponding to the linear exhaustion rate are advantageously based on the dyestuff having the highest exhaustion rate.

The total addition time may vary, depending on the dyeing conditions, e.g. the dyestuff used, the amount of salt etc. Preferably the salt and the alkali are simultaneously metered into the dyebath in small discrete quantities distributed over a total period, when expressed in minutes of from 15 to 70 minutes.

Suitable salts used for dyeing with reactive dyestuffs are known and are e.g. sodium or potassium sulphate or chloride. Suitable alkali include sodium or potassium hydroxide, carbonate, bicarbonate or silicate, borax or trisodium or tripotassium phosphate or mixtures thereof. The selection of the alkali reacting agent mainly depends on the type of reactive dyestuff used.

The total amounts of salt and alkali to be metered according to the invention lie within the known ranges for dyeing with reactive dyestuffs. They depend on the weight of the substrate to be dyed, on the depth of shade and the liquor ratio. The total amount of salt is conveniently from 1 to 200 g/l, preferably 1 to 100 g/l, more preferably 5 to 80 g/l. The alkali is advantageously added in a total amount ranging from 0.1 to 50 g/l, preferably 1 to 20 g/l.

In a preferred embodiment of the process of the invention, the amount of alkali is advantageously approximately 1/10 of that of the salt. More preferably, at such a ratio, the alkali used for the fixation is sodium carbonate.

The goods to liquor ratio may advantageously be within 1:1 and 1:100, preferably from 1:4 to 1:30.

The dyebath used in the process of the invention contains one or more reactive dyestuffs and optionally further ingredients such as a dispersing agent, a wetting agent, an emulsifying agent or a softening agent. Suitable reactive dyestuffs are those containing at least one fibre-reacting group; they include those belonging to the class of azo dyestuffs, anthraquinone dyestuffs, phthalocyanine metal dyestuffs and metal complex dyestuffs. Preferred reactive dyestuffs of these classes are those which are water-soluble and react with the cellulosic fibre at a temperature of from 20° to 100° C. at a pH from 8 to 12 in an exhaust dyeing process. More preferred reactive dyestuffs are those which contain at least one fibre-reacting group selected from monochlorotriazinyl, dichlorotriazinyl, monofluorotriazinyl, monofluoropyrimidinyl, difluoropyrimidinyl, fluorochloropyrimidinyl, dichlorchinoxalinyl, methylsulfonchloromethylpyrimidinyl and sulphatoethylsulphonyl. Such dyestuffs are known, e.g. from the Colour Index in which they are classified under the name Reactive Dyes.

The exhaust dyeing process of the invention is conveniently carried out at a temperature from 20° to 100° C., preferably 20° to 50° C., at a pH from 8 to 12. The temperature is raised to the dyeing temperature before starting the addition and is preferably kept constant during the simultaneous metering of the salt and the alkali reacting agent. When the addition of both is complete, the substrate may be further treated at the same temperature as at the end of the metering step or heated to a higher temperature for a period of e.g. 5 to 120 minutes to complete fixation. Preferably the substrate is further treated at the same temperature as that of the metering step for 5 to 120 minutes. The resulting substrate is then rinsed, washed and dried according to known methods.

The process of the invention is suitable for dyeing textile fibre material comprising natural or regenerated cellulose, preferably cotton. Blends of these textile fibres with synthetic fibres, e.g. polyester are also dyeable according to the process of the invention. The textile fibre material may be in any conventional form. The process of the invention is particularly useful for dyeing yarn, especially in package form which tends to give unlevel and non reproducible dyeing results.

In general, the process of the invention may be employed with all known exhaust dyeing apparatus which operate on a short or long liquor ratio principle. Examples are cheese and cone dyeing machines, beam dyeing machines, jiggers, jet dyeing machines, winch becks, paddle dyeing machines, packing machines, rotary dyeing machines and hank dyeing machines.

The simultaneous addition of the salt and the alkali to the dyebath may be carried out either separately or together in the form of a mixture, using one or two or even more appropriate metering device(s).

The salt and/or the alkali may be added to the dyebath either in solid form or in the form of an aqueous solution, concentrated or diluted.

Depending on the type of reactive dyestuff used and the depth shade, the optimal amount of salt required for the dyeing may be high. As the water solubility of the salt, especially sodium chloride, is limited in such a case where the addition of the salt and optionally the alkali is done in the form of an aqueous solution, the total volume to be metered in would be significant and would modify the original goods to liquor ratio. Therefore, it is recommended to avoid the addition of a salt and alkali total volume exceeding 10% (by volume) that of the original dyebath. Accordingly, the salt may be added in solid form and the alkali as an aqueous solution or vice versa or the salt may be added partially in the solid form and as an aqueous solution.

By metering simultaneously the salt and the alkali into the dyebath according to the invention, level and reproducible dyeings are obtained with a good tinctorial yield. The solubilising problems of the reactive dyestuff in the dyebath which are particularly critical with some dyestuffs, are significantly reduced or eliminated since the alkali is metered into the dyebath at the beginning of the procedure, the salt concentration in the dyebath being also low. Simultaneously as the salt concentration in the dyebath increases, the dyestuff concentration is reduced and the major part of the adsorbed dyestuff is fixed on the fibre by covalent bonding.

Another advantage of the process of the invention resides in the optimisation and rationalization of the dyeing procedure. The total amount of salt required for dyeing according to the process can be reduced since the alkali simultaneously metered into the dyebath, particularly when it is a salt such as sodium carbonate, also exerts an electrolyte effect. Due to the simultaneous addition, the dyeing with reactive dyestuffs is effected in one stage, like the dyeing with direct dyestuffs. The total dyeing time is therefore significantly shortened. The dyeing procedure can be fully automated and monitored by computer.

The process of the invention is particularly useful for dyeing in pale shades, especially fibre material in package form. Levelness and reproducibility are particularly critical and therefore difficult to be corrected in the case of pale depth dyeing.

The following Examples, in which all parts and percentages are by weight, illustrate the invention. The temperatures are in degrees Centigrade.

EXAMPLE 1

100 g cotton yarn in cheese form are introduced in a cheese and cone dyeing machine containing 2.5 g of the dyestuff C.I. Reactive Yellow 111 in 750 ml water at 40°. The dyebath is circulated at a flow rate of 4 cycles, i.e. 4 complete circulations of the complete dyebath volume per minute.

A solution of 50 g sodium sulphate and 5 g sodium carbonate in 250 ml water is added at 40° to the circulating dyebath at a linear rate of 0.416 g/l/cycle for the salt and 0.0416 g/l/cycle for the carbonate over 120 cycles for 30 minutes. Dyeing is performed at a linear dyebath exhaustion rate of 0.54%/cycle. After completion of the addition, the yarn is further treated for 90 minutes at a constant temperature of 40°. The dyebath is then discharged and the yarn treated according to known methods. A yarn dyed in a level penetrating yellow shade is thus obtained.

EXAMPLE 2

100 g cotton knitted goods are introduced in a jet dyeing machine which is charged with a dyebath at 40° containing 3.4 g of the dyestuff C.I. Reactive Red 147 in 1 l water.

A solution of 90 g sodium sulphate and 9 g sodium carbonate in 400 ml water is added at a linear rate of 2.14 g/l/min for the salt and 0.214 g/l/min for the carbonate over a period of 30 minutes. This period corresponds to 80 contacts dyebath/substrate. Dyeing is performed at a linear dyebath exhaustion rate of 0.56% /contact.

After completion of the addition, the knitted goods are further treated at 40° for 90 minutes. The dyebath is then discharged and the goods are rinsed and dried according to known methods. The resulting goods are dyed in a level red shade.

By following the procedure of Examples 1 and 2, level and reproducible dyeings are obtained with the reactive dyestuffs indicated in the following Table. A linear dyebath exhaustion rate as indicated is obtained when the sodium sulphate and sodium carbonate are simultaneously metered into the dyebath at the rate given in the Table. Dyeing is carried out at 40° at a goods to liquor ratio of 1:20.

TABLE

| Dyestuff C.I. Reactive | Amount of dyestuff in % based on the weight of substrate | Simultaneous addition over 30 minutes $Na_2SO_4$ g/l/min | $Na_2CO_3$ g/l/min | Linear dyebath exhaustion rate % dyebath exhaustion/min. |
|---|---|---|---|---|
| Yellow 125 | 1.5 | 1.66 | 0.166 | 2.6 |
| Yellow 125 | 0.5 | 0.66 | 0.066 | 2.7 |
| Orange 69 | 2.6 | 1.66 | 0.166 | 2.2 |
| Orange 69 | 0.85 | 1.0 | 0.1 | 2.7 |
| Red 147 | 3.4 | 2.0 | 0.2 | 1.4 |
| Red 147 | 1.1 | 1.33 | 0.133 | 1.9 |
| Blue 209 | 3.4 | 2.0 | 0.2 | 1.9 |
| Blue 209 | 1.1 | 1.33 | 0.133 | 2.4 |

Depending on the dyeing equipment used, these results may be expressed as a function/cycle, e.g. when the dyeing machine of Example 1 is used, the linear dyebath exhaustion rate is divided by four.

What is claimed is:

1. In a process wherein a textile material comprising cellulosic fibres is exhaust dyed with a reactive dyestuff in a dyebath which also contains a salt and an alkali, the improvement which comprises adding the salt and the alkali simultaneously to the reactive dyestuff-containing dyebath in specified quantities metered per unit time or per cycle of the dyeing machine so that a substantially constant percentage of the reactive dyestuff intially present in the dyebath is adsorbed by the substrate per unit time or per cycle of the dyeing machine.

2. A process according to claim 1, in which the salt and the alkali are simultaneously added to the dyebath according to a positive or negative exponential, logarithmic or power function.

3. A process according to claim 1, in which the salt and the alkali are simultaneously added to the dyebath according to a linear addition rate.

4. A process according to claim 1, in which the reactive dyestuff is adsorbed by the substrate at a linear rate of from 0.2 to 6%; based on the total dyestuff concentration initially present, per cycle.

5. A process according to claim 1, in which the total amount of salt to be metered is from 1 to 200 g/l.

6. A process according to claim 1, in which the total amount of alkali to be metered is from 0.1 to 50 g/l.

7. A process according to claim 1, in which the total amount of alkali is approximately 1/10 of that of the salt.

8. A process according to claim 1, in which the salt is sodium or potassium sulphate or chloride.

9. A process according to claim 1, in which the alkali is selected from the group consisting of sodium and potassium hydroxide, carbonate, bicarbonate or silicate, borax, trisodium or tripotassium phosphate and mixtures thereof.

10. A process according to claim 1, in which the goods to liquor ratio is from 1:1 to 1:100.

11. A process according to claim 1, in which the reactive dyestuff contains at least one fibre-reacting group selected from monochlorotriazinyl, dichlorotriazinyl, monofluorotriazinyl, monofluoropyrimidinyl, difluoropyrimidinyl, fluorochloropyrimidinyl, dichlorochinoxalinyl, methylsulfo-chloromethylpyrimidinyl and sulphatoethylsulphonyl.

12. A process according to claim 1 carried out at a constant temperature of from 20° to 100° C.

13. A process according to claim 1 carried out at a pH of from 8 to 12.

14. A process according to claim 1, in which the textile material comprises cotton or a blend thereof with synthetic fibres.

15. A process according to claim 3 in which the salt is sodium or potassium sulphate or sodium or potassium chloride.

16. A process according to claim 4 in which the salt is soduim or potassium sulphate or sodium or potassium chloride.

17. A process according to claim 7 in which the alkali is sodium carbonate.

18. A process according to claim 8 wherein the total amount of salt to be metered is from 1 to 200 g/l and the total amount of alkali to be metered is from 0.1 to 50 g/l.

19. A process according to claim 8 wherein the alkali is selected from the group consisting of sodium and potassium hydroxide, carbonate, bicarbonate and silicate, borax, trisodium and tripotassium phosphate and mixtures thereof.

20. A process according to claim 15 wherein the reactive dyestuff is adsorbed by the substrate at a linear rate of from 0.2 to 6%, based on the total dyestuff concentration initially present, per cycle.

21. A process according to claim 15 wherein the alkali is selected from the group consisting of sodium and potassium hydroxide, carbonate, bicarbonate and silicate, borax, trisodium and tripotassium phosphate and mixtures thereof.

22. A process according to claim 20 wherein the alkali is selected form the group consisting of sodium and potassium hydroxide, carbonate, bicarbonate and silicate, borax, trisodium and tripotassium phosphate and mixtures thereof.

23. A process according to claim 20 wherein the pH is from 8 to 12 and the temperature is from 20° to 100° C. and is kept constant during the metering of the salt and alkali.

24. A process according to claim 21 wherein the pH is from 8 to 12 and the temperature is from 20° to 100° C. and is kept constant during the metering of the salt and alkali.

25. A process according to claim 22 wherein the pH is from 8 to 12 and the temperature is from 20° to 100° C. and is kept constant during the metering of the salt and alkali.

26. A process according to claim 22 wherein the total amount of salt to be metered is from 1 to 200 g/l and the total amount of alkali to be metered is from 0.1 to 50 g/l.

27. A process according to claim 25 wherein the total amount of salt to be metered is from 1 to 200 g/l and the total amount of alkali to be metered is from 0.1 to 50 g/l.

28. A process according to claim 27 wherein the reactive dyestuff contains at least one fibre-reacting group selected from monochlorotriazinyl, dichlorotriazinyl, monofluorotriazinyl, monofluoropyrimidinyl, difluoropyrimidinyl, fluorochloropyrimidinyl, dichlorochinoxalinyl, methylsulfo-chloromethylpyrimidinyl and sulphatoethylsulphonyl.

29. A process according to claim 15 wherein the addition of salt and alkali and the adsorption of the dyestuff are controlled per cycle of the dyeing machine.

30. A process according to claim 20 wherein the addition of salt and alkali and the adsorption of the dyestuff are controlled per cycle of the dyeing machine.

31. A process according to claim 22 wherein the addition of salt and alkali and the adsorption of the dyestuff are controlled per cycle of the dyeing machine.

32. A process according to claim 25 wherein the addition of salt and alkali and the adsorption of the dyestuff are controlled per cycle of the dyeing machine.

33. A process according to claim 8 wherein the temperature of the dyebath is raised to the dyeing temperature before addition of the salt and alkali.

34. A process according to claim 19 wherein the temperature of the dyebath is raised to the dyeing temperature before addition of the salt and alkali.

35. A process according to claim 20 wherein the temperature of the dyebath is raised to the dyeing temperature before addition of the salt and alkali.

36. A process according to claim 31 wherein the temperature of the dyebath is raised to the dyeing temperature before addition of the salt and alkali.

37. A process according to claim 1 wherein the salt and alkali are added simultaneously to the dyebath according to a linear or a positive or negative exponential rate.

38. A process according to claim 24 wherein the temperature of the dyebath is raised to the dyeing temperature before addition of the salt and alkali.

39. A process according to claim 38 wherein the addition of salt and alkali and the adsorption of the dyestuff are controlled per cycle of the dyeing machine.

* * * * *